US006612084B2

(12) United States Patent
Rapisarda et al.

(10) Patent No.: US 6,612,084 B2
(45) Date of Patent: Sep. 2, 2003

(54) CLEAN ROOM AND METHOD

(75) Inventors: Joseph Rapisarda, Chandler, AZ (US); Timothy Colley, Tempe, AZ (US)

(73) Assignee: SpeedFam-IPEC Corporation, Chandler, AZ (US)

( * ) Notice: Subject to any disclaimer, the term of this patent is extended or adjusted under 35 U.S.C. 154(b) by 0 days.

(21) Appl. No.: 09/993,534

(22) Filed: Nov. 14, 2001

(65) Prior Publication Data

US 2002/0108334 A1 Aug. 15, 2002

Related U.S. Application Data

(62) Division of application No. 09/391,113, filed on Sep. 7, 1999.

(51) Int. Cl.[7] ..... E04C 2/32; E04C 2/38

(52) U.S. Cl. ..... 52/630; 52/302.1; 52/742.14; 264/31

(58) Field of Search ..... 454/187; 52/630, 52/742.14, 745.01, 745.05, 220.3, 220.8, 302.1; 264/31, 333

(56) References Cited

U.S. PATENT DOCUMENTS

| | | | | |
|---|---|---|---|---|
| 844,296 A | | 2/1907 | Winslow | |
| 1,562,865 A | | 11/1925 | Brown | |
| 2,593,424 A | * | 4/1952 | Edgerly | 237/69 |
| 3,023,689 A | | 3/1962 | Kurek | |
| 3,057,271 A | * | 10/1962 | Butler et al. | 52/179 |
| 3,158,457 A | * | 11/1964 | Whitfield | 454/187 |
| 3,367,257 A | | 2/1968 | Raider et al. | |
| 3,811,237 A | * | 5/1974 | Bettinger | 52/126 |
| 3,850,193 A | | 11/1974 | Guzzo | |
| 4,043,354 A | | 8/1977 | Brown | |
| 4,699,640 A | | 10/1987 | Suzuki et al. | |
| 4,747,341 A | | 5/1988 | Hedrick | |
| 4,832,562 A | | 5/1989 | Johnson | |
| 4,883,590 A | | 11/1989 | Papp | |
| 5,058,491 A | * | 10/1991 | Wiemer et al. | 454/187 |
| 5,067,289 A | | 11/1991 | Ouderkirk et al. | |
| 5,444,947 A | | 8/1995 | Miller | |
| 5,518,451 A | * | 5/1996 | Renz et al. | 181/225 |
| 5,542,223 A | | 8/1996 | Inda et al. | |
| 5,564,235 A | | 10/1996 | Butler | |
| 5,692,954 A | | 12/1997 | Lee et al. | |
| 5,843,324 A | * | 12/1998 | Shirley | 249/177 |
| 6,202,374 B1 | | 3/2001 | Cooper et al. | |

FOREIGN PATENT DOCUMENTS

| | | | |
|---|---|---|---|
| DE | 38 32 915 A1 | 3/1990 | F24F/7/10 |
| EP | 0 079 066 A1 | 5/1983 | E04F/15/024 |

* cited by examiner

*Primary Examiner*—Carl D. Friedman
*Assistant Examiner*—Basil Katcheves
(74) *Attorney, Agent, or Firm*—Snell & Wilmer, L.L.P.

(57) ABSTRACT

A clean room which avoids the problems attendant with the raised floor found in prior art clean rooms uses a perforated floor upon which equipment can be directly placed. The perforated floor includes a regular array of openings through which air can pass to an underlying facility room. The openings are covered by a grate through which the air can pass. In combination the perforated floor and the grates are able to support equipment in any location thereon.

7 Claims, 6 Drawing Sheets

CLEAN ROOM AND METHOD

CROSS REFERENCE TO RELATED APPLICATIONS

This is a Divisional application of U.S. Ser. No. 09/391,113 filed on Sep. 7, 1999, which is hereby incorporated by reference.

BACKGROUND OF THE INVENTION

This invention relates generally to a clean room, and more specifically to a floor for a clean room and to a method for establishing a clean room.

Clean rooms are used extensively in the electronics industry and in other industries in which a clean, particle free environment is necessary during the fabrication or testing of a product. Clean rooms are rated by the number of particles of a given standard size that are detected in a standard volume of air within the clean room. According to this rating system a "Class 10" clean room has only one-tenth the particle count of a "Class 100" clean room. Similarly, a "Class 1" clean room has only one-tenth the particle count of a "Class 10" clean room. The low particle count in a clean room is achieved by a large number of distributed air changes in the room. Air flows through the room, usually in a laminar fashion and usually downwardly from the ceiling to the floor or to vents located near the floor. The air changes wash the particulate matter from the room. Other things being equal, the greater the number of air changes, the lower the particle count in the room. For example, a "Class 1" clean room usually requires more than 450 air changes per hour.

Typically the air in a clean room enters the room through filters located in the ceiling, passes through the room, washing over the contents of the room, and exits the room through openings or vents in a raised clean room floor to a plenum formed between the raised floor and the structural floor of the building. The air is then recirculated and again passes through the ceiling filters and into the room.

Prior art clean rooms have all used a raised clean room floor. The raised and usually perforated clean room floor is supported on a pedestal or plurality of pedestals. The pedestals are usually specially constructed structures designed specifically for the equipment that is to be placed on the raised floor. The raised floor itself is inadequate to support the weight of the equipment. The necessary pedestal is often very expensive, sometimes having a cost equaling a large percentage of the total equipment cost. The raised floor is necessary to form the return air plenum and to provide a way to facilitate the equipment. Power lines, chemical lines, exhausts, drains, and the like pass through the raised floor and run under the raised floor to a facilities area. In addition, another reason for the widespread use of raised clean room floors, it is the desire, and often necessity, of suppressing vibrations caused by the equipment located in the clean room. Much of the processing that is done in the clean room requires a vibration free environment as well as a particle free environment. The raised floor and the platform upon which the raised floor is supported dampen vibrations that otherwise might be propagated by the underlying structural floor. A concrete slab floor has not been found satisfactory for a clean room environment because the slab tends to be a conduit for vibration.

In addition to the expense of the customized pedestal that must be used to support a raised clean room floor, there are a number of other significant drawbacks to such a floor. Because the raised floor, by itself, is unable to support the weight of equipment that might be placed in the clean room, the raised floor also cannot support the weight of that equipment as it is moved into a clean room. This results in the necessity for disassembling the raised floor when equipment is moved into a clean room or is moved about the clean room. The floor is disassembled, equipment is moved into the clean room, placed on the portion of the raised floor in substantially its final location, and then the remaining portion of the raised floor is reassembled. This activity compromises the cleanliness of the clean room every time a piece of equipment is moved into or is moved about the clean room. In addition, any facilities lines that would be located under the portion of the raised floor that has to be removed will also be disturbed by the moving of equipment. Because of these difficulties, it is commonplace to build relatively small or compartmentalized clean rooms so that only a small area is contaminated by any moving process. This, of course, leads to disadvantages in terms of material flow because materials being processed must be moved into and out of these individual compartmentalized clean rooms.

In view of these and other problems with conventional clean room designs, it has been recognized that a need exists for a clean room that is less expensive than a raised floor clean room. There is also a need for a clean room that allows for non-intrusive clean room practices for facilitizing equipment located in the clean room. The need also exists for a clean room that does not require an expensive and customized pedestal for equipment, but rather allows the placement of equipment anywhere within a clean room. There is also a need for a clean room into which equipment can be moved and relocated without compromising the integrity of the clean room. A need also exists for a clean room that can be large in area and arbitrarily expandable in area.

BRIEF SUMMARY OF THE INVENTION

In accordance with one embodiment of the invention, a clean room is provided having a bearing floor capable of supporting equipment in any location thereon. The bearing floor is positioned over a facilities room which, in effect, is an extension of the clean room. The bearing floor has a regular array of openings through the floor which permit air to flow from the clean room into the underlying facilities room. A wall structure is positioned on the bearing floor to surround a selected area of the bearing floor. A ceiling having a plurality of filtered air inlets is provided above the bearing floor and in contact with the top of the wall structure. A plurality of grates are positioned in those floor openings of the regular array that are located within the selected area bounded by the walls and solid, air impervious members are positioned in those floor openings of the regular array that are located outside the selected area. By changing air impervious members for grates, or vice versa, the area of the clean room can be expanded or reduced. Preferably the location and number of filtered air inlets is also adjusted to correspond to the number of grated openings in the clean room floor.

DETAILED DESCRIPTION OF PREFERRED EMBODIMENTS

Figure 1:
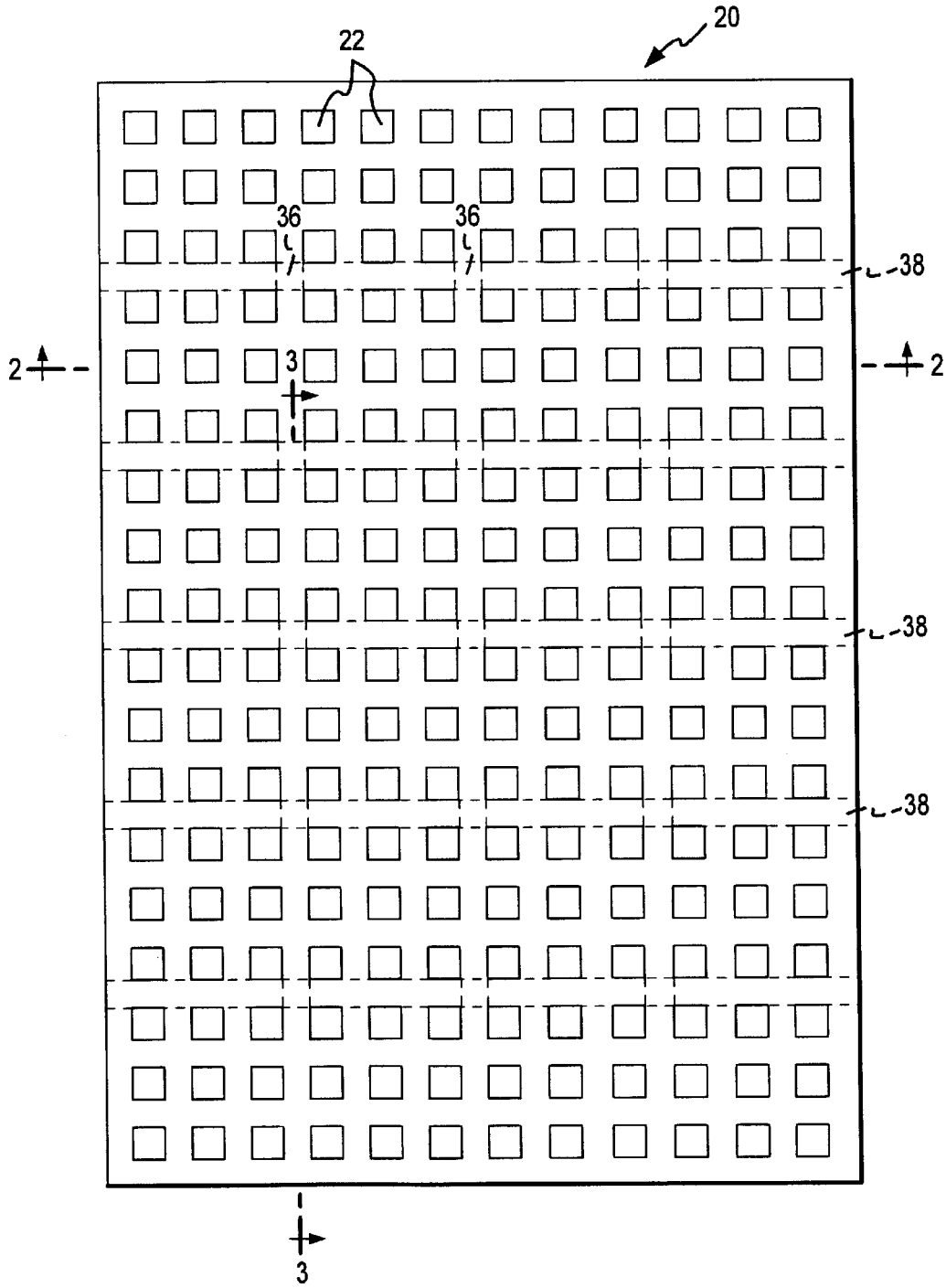
FIG. 1 illustrates, in plan view, a perforated clean room floor in accordance with one embodiment of the invention.
Figure 2:
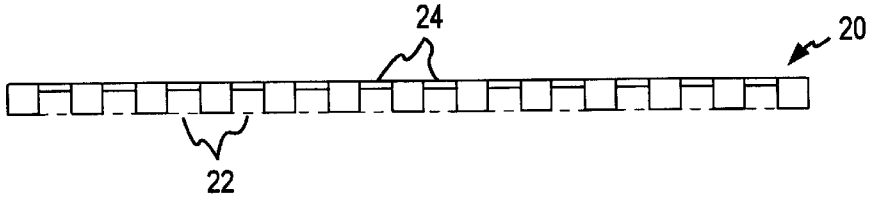
FIG. 2 illustrates, in cross-section, a clean room floor in accordance with the invention.

FIG. 1 illustrates, in plan view a floor 20 for a clean room in accordance with the invention. FIG. 2 illustrates a cross-section taken through the floor 20, as indicated, and FIG. 3 illustrates a further cross-section through floor 20 and the substucture, as indicated.

Figure 3:
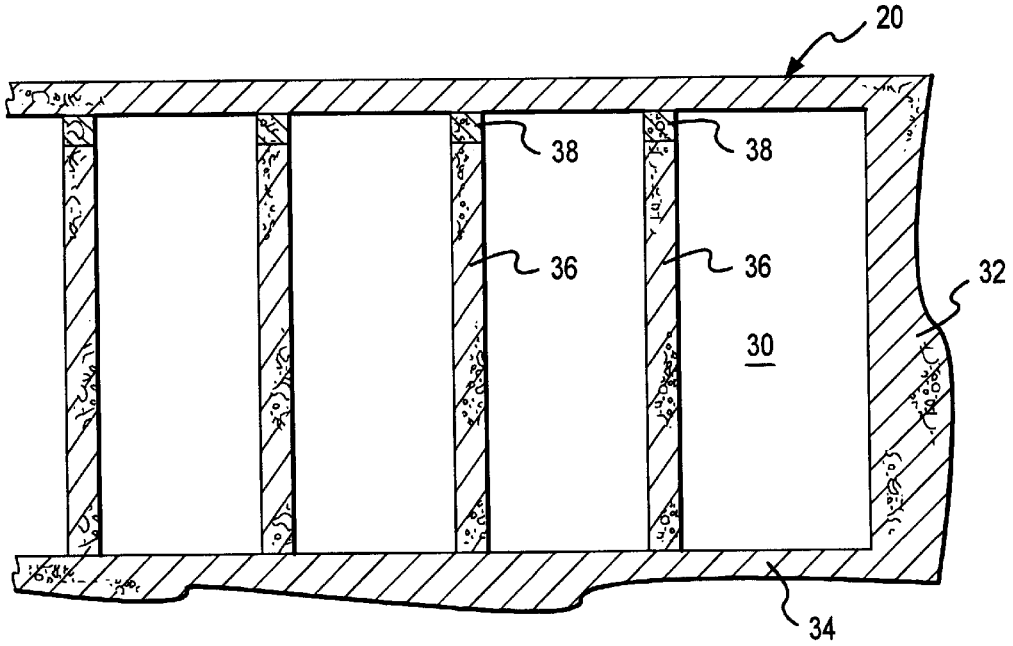
FIG. 3 illustrates, in cross-section, a portion of a clean room facility.

In accordance with one embodiment of the invention, as illustrated in FIGS. 1–3, the floor 20 is a poured in place concrete floor having a plurality of openings 22 extending through the thickness of the floor. Preferably the plurality of openings 22 are arranged in a regular array. The openings can be, for example, square openings having a side dimension of two feet with a spacing of two feet between openings. As will be explained below, each of the openings has a cover 24 inserted therein with the top of the cover co-planar with the top of the solid floor. The cover consists of either a grate or an air impermeable cover, depending upon the location within the clean room floor. Floor 20 is constructed overlying a room 30. Preferably room 30 is a below grade basement. Room 30 can be used advantageously to house facilities to be used by the equipment employed in the clean room. Accordingly, room 30 will be referred to herein as a facility room. Room 30 includes, as illustrated in FIG. 3, bearing side walls 32 and a supporting concrete floor 34. A plurality of support pillars 36 extend upwardly from the concrete slab floor 34. A plurality of beams 38 span the facility room 30 and are supported by the plurality of columns 36. The support beams 38, in turn, support the perforated clean room floor 20. The facility room floor 34, walls 32, support pillars 36, beams 38, and floor 20 are preferably constructed of reinforced concrete. The composition of the concrete and the size and amount of rebar used for reinforcing are determined in accordance with standard structural calculations to support the weight of the equipment intended to be used in the clean room. Sound engineering practice, of course, dictates that the structure be overdesigned to support a weight much greater than that actually intended to be used in the clean room.

Figure 4:
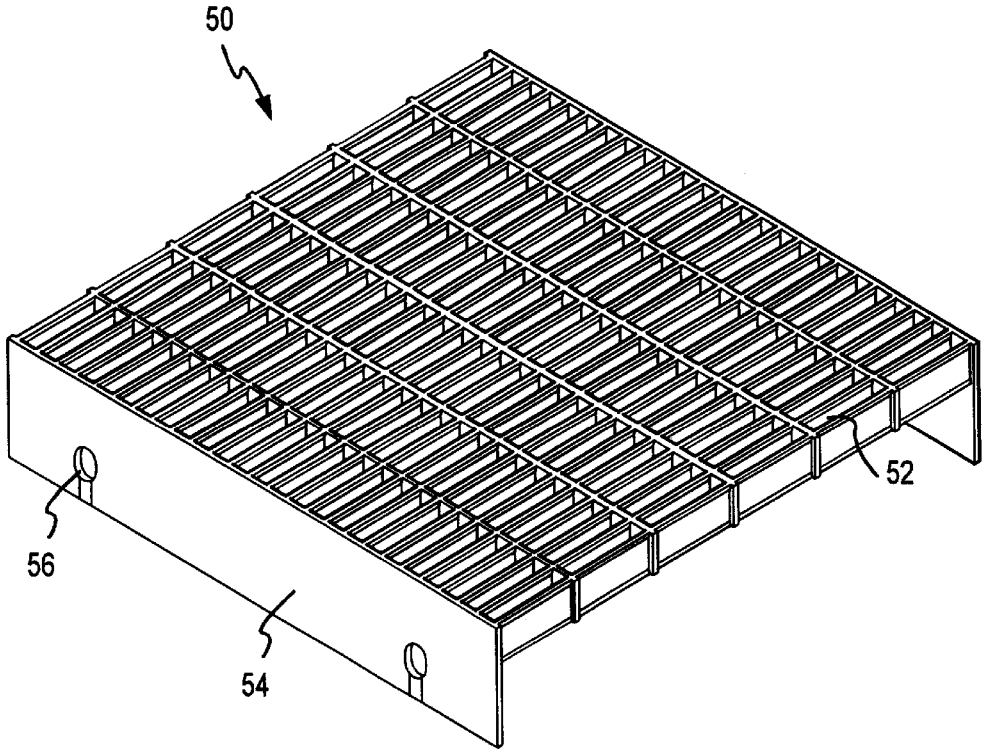
FIGS. 4 and 5 illustrate a grate and its method for installation in a perforated floor in accordance with one embodiment of the invention.
Figure 5:
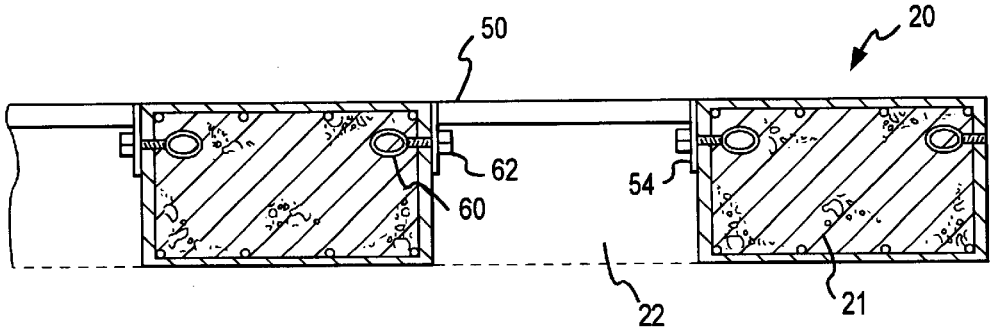

A preferred grate structure 50 to be used as one of the covers 24 inserted in an opening 22 in a clean room floor is illustrated in FIG. 4. FIG. 5 illustrates how that grate is held in place within the floor 20. Grate 50 includes a mesh top 52 and an apron 54 extending downwardly from at least two of the sides of the mesh top. Slots 56 are provided in the apron to allow adjustable attachment of the grate within opening 22 as will be explained below. The grates can be made of any suitable, structurally sound material. Preferably the grates are made of a metal such as stainless steel. The mesh top is designed to provide the free flow of air therethrough and simultaneously to provide structural strength. In accordance with one embodiment of the invention, the mesh top is fabricated from stainless steel and has openings of about 1 inch by 4 inches. The mesh top can be about 1½–2 inches in height and the apron is preferably about 4–5 inches in height.

FIG. 5, which illustrates a portion of floor 20 in cross-section, depicts a preferred method for attaching the grates within the openings 22. During the pouring of concrete floor 20, ferrule loops 60 are embedded in the solid portion 21 of floor 20. Preferably four ferrule loops are embedded in the walls of each of the openings 22, two each on opposing sides of the opening. The ferrule loops are positioned to align with slots 56 in the grates. A ferrule loop is used because the loop portion provides a good anchoring mechanism within the concrete material. The end of the ferrule loop extending out from the concrete is threaded to receive a bolt 62. The grate is placed in the opening so that the slots 56 in apron 54 are positioned over the threaded ends of ferrule loops 60. Bolts 62 are threaded onto the ferrule loops, the height of the grate is adjusted to be substantially co-planar with the surface of the concrete 21, and the bolts are tightened to hold the aprons and therefore, the grates securely in this aligned position.

Figure 6:
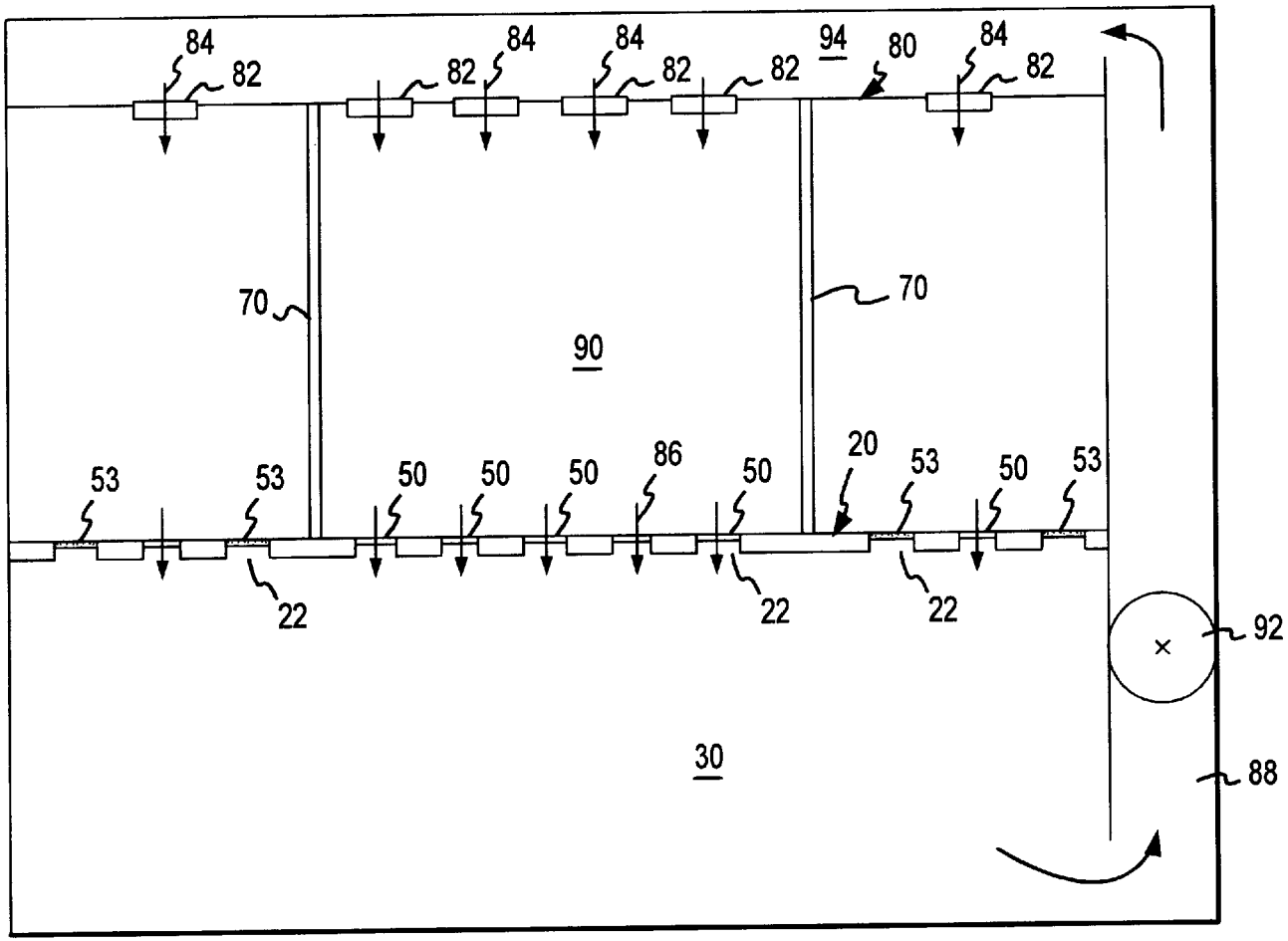
FIG. 6 illustrates schematically, in cross-section, a clean room facility in accordance with the invention.
Figure 7:
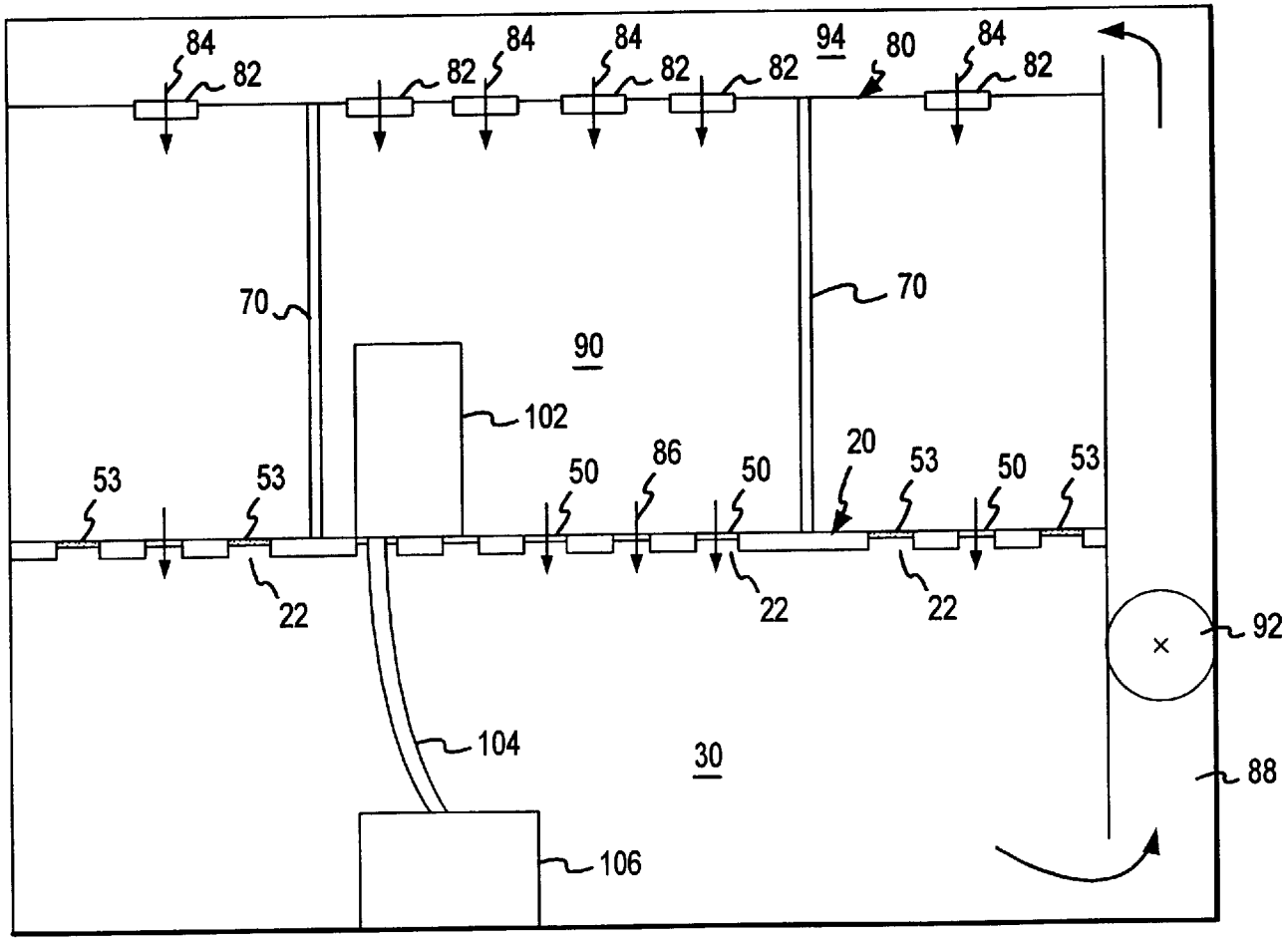
FIG. 7 illustrates a facilities line extending between clean room equipment and facilities equipment.

The clean room facility, in accordance with the invention, is further illustrated schematically in FIG. 6. In this illustration the clean room facility is illustrated along a vertical cross-section. The clean room facility includes facility room 30 as previously described. Overlying the facility room is a perforated floor 20. Vertical walls 70 surround an area of the perforated floor 20. The area of the perforated floor surrounded by walls 70 may encompass all of the perforated floor or, alternatively, a portion of the floor, leaving a second portion of the floor external to the walls 70. A ceiling 80 overlies perforated floor 20 including the portion of the perforated floor that is enclosed by walls 70. An airtight seal is made between the walls 70 and the ceiling 80 and also between the walls 70 and the perforated floor 20. Walls 70, a portion of ceiling 80, and a portion of perforated floor 20 thus enclose a volume constituting the clean room 90. Ceiling 80 includes a plurality of filtered air inlets 82. The filtered air inlets 82 have a greater density over the clean room 90 than they do over the area outside walls 70. In addition, the openings 22 which extend through floor 20 and which are located within the area bounded by walls 70 are covered by grates 50. The majority of the openings 22 through the floor 20 which are located outside the clean room 90 are covered by an area impervious cover 53.

Air circulation through the clean room facility is also illustrated in FIG. 6. Air enters clean room 90 through the filtered air inlets 82 as illustrated by arrows 84. The filtered air passes through clean room 90 and is exhausted into facility room 30 through the openings 22 in perforated floor 20 as illustrated by the arrows 86. Air is then exhausted from facility room 30 through an air plenum 88. A blower 92 conveys the air to a further plenum 94 which overlies ceiling 80. The air is then again filtered and forced through filtered air inlets 82. In this manner repeated air changes within clean room 90 "wash" particulate matter from the clean room. The number of air changes in clean room 90 is a function of the speed with which the air is circulated by blower 92, by the number of air inlets 82, and by the number of openings 22 through which the air can be exhausted into facility room 30. Because of the lower density of filtered air inlets in the region outside of walls 70 and because of the smaller number of openings 22 through which air can be exhausted, the particle count outside of clean room 90 will be greater than the particle count within the clean room.

The concept illustrated in FIG. 6 has a very important advantage over prior art clean rooms. A relatively large perforated floor 20 can be initially constructed over a relatively large facility room 30. Thereafter temporary walls 70 can be constructed on floor 20 to construct a clean room of any desired size up to and including a clean room encompassing all of floor 20. To change the size of clean room 90 requires only that the walls 70 be moved, the coverings on openings 22 be changed from air impervious to grates or vice versa, and the ceiling tiles be changed to increase or decrease the area of high density filtered air inlets.

Floor 20 is designed and constructed to be a load bearing floor. The floor is designed so that equipment can be placed directly on the perforated floor at any location within the clean room 90 regardless of the size of the clean room. Because equipment can be placed and supported anywhere on the perforated floor, equipment can be moved into and out of the clean room at will, and can be placed in any location within the clean room. Moving equipment into or about clean room 90 does not require the dismantling of a raised floor nor the assembly or moving of a costly support platform upon which the equipment must rest. Equipment can easily be moved into or out of clean room 90 on an air palette without compromising the cleanliness of the clean room. An air palette can easily move across the perforated floor by placing thin sheets of air impervious material such as thin sheets of plastic or metal over the floor grates as a temporary measure while the air palette passes over the grates.

In addition, all facilities lines such as gas lines, chemical lines, power lines, and the like can be routed from the equipment through the nearest opening 22 to the facilities room below. This is in contrast to the conventional raised floor clean room in which facilities lines are routed underneath the raised floor. Thus, in accordance with the invention, facilities lines need not be routed across the floor and thus need not impede the movement of equipment across the floor.

In a preferred method the clean room in accordance with the invention is constructed as follows. The facilities room 30 is first constructed in accordance with normal construction practices utilized in the building of fabrication facilities for the electronics and other similar industries. Preferably, facilities room 30 is constructed below grade and the floor and walls of the facility room are poured concrete constructed on substantial footings to minimize terrestrial vibration. Support pillars 36 and beams 38 are then erected in accordance with calculations done, as described earlier, on the size and reinforcing necessary to support the intended load. When properly designed in this manner, the perforated floor to be constructed overlying the beams can be extended to virtually any size by repeating the pattern of support pillars and beams. A clean room of any desired size can thus be constructed in this manner.

After the support pillars and beams are in place, temporary forms are erected over the beams. In accordance with a preferred embodiment the concrete forms for the perforated floor include a regular array of wooden boxes having the size desired for the openings in the floor. These wooden boxes can be made, for example, from plywood and are supported on or integral with the concrete forms. Ferrule loops 60 are attached to the wooden boxes for the ultimate attachment of the floor grates 50. With the forms including the wooden boxes in place, and with the appropriate amount of reinforcing rods in place, the perforated concrete floor is poured to a depth substantially co-planar with the tops of the array of wooden boxes. After the concrete has set, the wooden boxes can be broken apart and removed leaving the ferrule loops in place in the edges of the openings through the concrete floor. In those areas which are not intended for immediate use as a clean room area, a temporary, air impervious cap can be placed in the openings 22. One way to form the air impervious caps, for example, is to pour about 4 inches of concrete in each of the openings that are not intended to receive a grate. Upon later expansion of the clean room, the 4 inches of concrete can easily be removed. Until so removed, however, the 4 inches of concrete is adequate to provide a safe floor upon which foot traffic and some equipment can be moved. Alternatively, temporary air impervious caps can be placed in those openings which are not initially intended to receive a grate. Temporary caps can be made from concrete, solid pieces of metal, or the like. Such caps can also be affixed to the ferrule loops.

One difficulty with solid concrete floors in a fabrication area is that vibrations tend to propagate along a concrete slab. Thus vibration generated by one piece of equipment may adversely affect the performance of an adjacent piece of equipment. It has been discovered, however, that the perforated floor in accordance with the invention does not have this problem of easy propagation of vibrations. Instead, it has been discovered that the perforated floor in accordance with the invention serves to dampen vibrations.

Although not illustrated in any of the figures, one further embodiment of the invention includes the incorporation of adjustable louvers in the metal grates 50. Such adjustable louvers allow for adjusting the air flow through the clean room facility.

Thus it is apparent that there has been provided, in accordance with the invention, a clean room facility and a method for its fabrication that overcomes the disadvantages of prior art clean rooms. Although the invention has been described and illustrated with respect to specific illustrative embodiments thereof, it is not intended that the invention be limited to these illustrative embodiments. For example, those of skill in the art will recognize that other building materials and dimensions can be substituted for those set forth in the specific examples given above. For example, the size and spacing of the openings through the floor can be changed to accommodate particular clean room layouts or particular equipment. Likewise, different forms or shapes of the grates can be utilized as would be obvious to those of skill in the art. Accordingly, it is intended to encompass within the invention all variations and modifications as fall within the scope of the appended claims.

What is claimed is:

1. A method for fabricating a clean room facility comprising the steps of:

constructing a first room having a structurally solid floor;

forming a plurality of support pillars extending above said solid floor;

providing a plurality of beams spanning said support pillars, said support pillars and said beams designed to provide a low vibration environment for equipment to be located in said clean room facility;

providing concrete forms for the pouring of a concrete floor overlying said beams, said forms comprising a regular array of demountable boxes upstanding from a surface of said forms;

pouring a concrete floor overlying said beams, the upper surface of said concrete floor being substantially coplanar with the upper surface of said demountable boxes;

removing said demountable boxes to leave a concrete floor having a regular array of openings therethrough;

erecting walls surrounding an area on said concrete floor;

constructing a ceiling overlying said concrete floor, said ceiling having a plurality of filtered air inlets therethrough and forming an air tight seal with said walls; and providing an air recirculation system to circulate air through said filtered air inlets, through said plurality of openings, into said first room, and back to said filtered air inlets.

2. The method of claim 1 further comprising the step of providing a temporary solid cover for a portion of said array of openings positioned outside said area.

3. The method of claim 2 wherein said step of providing a temporary solid cover comprises pouring a concrete cover.

4. The method of claim 1 further comprising the step of inserting a grate into a second portion of said array of openings positioned inside said area.

5. The method of claim 4 wherein said step of inserting comprises anchoring a plurality of ferrule loops in the walls of said openings and bolting grates to said ferrule loops.

6. The method of claim 1 wherein said step of constructing a ceiling comprises the steps of providing a first density of filtered air inlets overlying said area and providing a second, lower density of filtered air inlets overlying portions of said floor outside said area.

7. The method of claim 1 further comprising the step of routing facilities through selected ones of said regular array of openings from said first room to locations above said concrete floor.

* * * * *